US008733807B2

(12) United States Patent
Williams

(10) Patent No.: US 8,733,807 B2
(45) Date of Patent: May 27, 2014

(54) SELF-ADJUSTING STRIKER ASSEMBLY

(75) Inventor: David A. Williams, Milton, FL (US)

(73) Assignee: Daws Manufacturing Company, Inc., Pensacola, FL (US)

( * ) Notice: Subject to any disclaimer, the term of this patent is extended or adjusted under 35 U.S.C. 154(b) by 27 days.

(21) Appl. No.: 13/305,856

(22) Filed: Nov. 29, 2011

(65) Prior Publication Data

US 2012/0067895 A1 Mar. 22, 2012

Related U.S. Application Data

(63) Continuation-in-part of application No. 12/714,893, filed on Mar. 1, 2010, now Pat. No. 8,382,171.

(51) Int. Cl.
*E05B 15/02* (2006.01)

(52) U.S. Cl.
USPC ..... 292/341.15; 292/340

(58) Field of Classification Search
USPC ..... 292/341.18, 341.19, 340
See application file for complete search history.

(56) References Cited

U.S. PATENT DOCUMENTS

| | | | | |
|---|---|---|---|---|
| 148,662 | A | 3/1874 | Burr | |
| 446,173 | A | 2/1891 | Hancock | |
| 2,275,760 | A | 3/1942 | Hoffman | |
| 2,428,207 | A | 9/1947 | Dzurinda | |
| 2,583,391 | A * | 1/1952 | Quinn | 292/341.15 |
| 2,669,477 | A | 2/1954 | Jewell | |
| 3,179,458 | A | 4/1965 | Sconzo | |
| 4,305,611 | A | 12/1981 | Robins | |
| 4,432,575 | A | 2/1984 | Garvey et al. | |
| 4,470,626 | A | 9/1984 | Gergoe et al. | |
| 4,522,436 | A | 6/1985 | Hoen et al. | |
| 4,988,134 | A | 1/1991 | Vidwans et al. | |
| D319,001 | S | 8/1991 | Weinerman et al. | |
| 5,161,851 | A | 11/1992 | Rafi-Zadeh | |
| 5,193,868 | A | 3/1993 | O'Toole | |
| 5,226,302 | A | 7/1993 | Anderson | |
| 5,342,103 | A | 8/1994 | Tame et al. | |
| 5,524,978 | A | 6/1996 | Tunis et al. | |
| 5,669,638 | A | 9/1997 | Anderson et al. | |
| 5,707,092 | A | 1/1998 | Van Slembrouck et al. | |
| 5,938,254 | A * | 8/1999 | Weyerstall | 292/341.16 |
| 6,149,213 | A | 11/2000 | Sokurenko et al. | |
| 6,334,560 | B1 | 1/2002 | Lentini | |
| 6,783,163 | B2 | 8/2004 | Sadler | |
| 6,817,637 | B1 | 11/2004 | Anderson | |
| 7,261,337 | B2 | 8/2007 | Nakagome et al. | |
| 7,341,292 | B2 * | 3/2008 | Brose et al. | 292/341.15 |
| 7,416,228 | B2 | 8/2008 | Pfitzinger et al. | |
| 7,469,945 | B2 | 12/2008 | Dennis | |
| 7,568,745 | B2 * | 8/2009 | Brose et al. | 292/341.15 |
| 7,744,135 | B2 | 6/2010 | Wiese et al. | |
| 2006/0145487 | A1 | 7/2006 | Wilder | |

FOREIGN PATENT DOCUMENTS

| | | | |
|---|---|---|---|
| AU | 703274 | B2 | 7/1996 |
| CA | 1046552 | A1 | 1/1979 |
| CN | 200943344 | Y | 9/2007 |
| FR | 2752865 | A1 | 3/1998 |

* cited by examiner

*Primary Examiner* — Carlos Lugo
*Assistant Examiner* — Faria Ahmad
(74) *Attorney, Agent, or Firm* — GrayRobinson, P.A.

(57) ABSTRACT

A self-adjusting striker assembly, for use with a box having a lid, a box body and a latch, includes a striker bar mounted to the lid which is operative to move linearly relative to the latch in the event of misalignment between the lid and box body.

6 Claims, 11 Drawing Sheets

SELF-ADJUSTING STRIKER ASSEMBLY

CROSS-REFERENCE TO RELATED APPLICATIONS

This application is a continuation-in-part of co-pending U.S. patent application Ser. No. 12/714,893 filed Mar. 1, 2010. U.S. application Ser. No. 12/714,893 is expressly incorporated herein by reference in its entirety to form part of the present disclosure.

FIELD OF THE INVENTION

This invention relates to tool boxes, and, more particularly, to a self-adjusting striker assembly for use with latches in tool boxes that accommodates misalignment between the lid of the box and the latches.

BACKGROUND OF THE INVENTION

One of the most popular accessories for trucks and recreational vehicles is a truck tool box used to store and secure a variety of tools and other items in the bed of the vehicles. There are a number of different types of truck boxes, including cross-over boxes, side mount boxes, chest boxes, top mount boxes, RV boxes and others. Each truck box is typically formed of aluminum tread plate, and comprises a front wall, a back wall, a bottom wall and opposed end walls which are interconnected to define a hollow interior. The truck box interior is closed by a top lid that is pivotal on one or more hinges, usually with the assistance of gas springs.

In many truck box designs, one or more latch mechanisms and striker bars are provided to maintain the top lid in a closed and locked position to secure the contents of the box. The latch mechanism(s) may be mounted to the front wall of the box, for example, in which case the striker bar(s) is mounted to the top lid. When the top lid is closed, each striker bar engages a latch mechanism to lock the top lid in place. In order for the striker bar and latch to properly engage one another, they must be in alignment, which, in turn, depends on appropriate alignment of the top lid and the body of the truck box. Many factors can contribute to altering the relationship between the top lid and box body, including rough handling during shipment, improper installation on the vehicle, damage to the body panels of the box during off-road adventures or the like and other factors. If each latch does not align with a striker bar, adjustment must be made in order for the top lid to properly close and lock.

Many striker bar—latch constructions in the prior art permit manual adjustment of the striker bar with respect to the latch. Typically, the position of the striker bar may be altered by loosening nuts securing the striker bar to the top lid or front wall of the box and then manually shifting its position relative to the latch. This can be a tedious exercise, and seems to invariably occur when the vehicle owner has the least amount of time to correct the situation.

Self-adjusting striker bar assemblies have been suggested in the prior art as a means of providing at least some adjustment of the position of the striker bar relative to the latch without the need for manual intervention. See, for example, U.S. Pat. Nos. 7,416,228 and 5,342,103. In these patents, the striker bar is pivotally mounted to the top lid or box body and can move in a swinging, pendulum-type motion relative to the latch mechanism which is mounted on or adjacent to a plate formed with a notch. In the event of misalignment between the striker bar and latch mechanism, the striker bar contacts a side of the notch and pivots to a position in alignment with the latch mechanism.

SUMMARY OF THE INVENTION

This invention is directed to a self-adjusting striker assembly for use with a truck box, or essentially any other type of box, having a hollow interior defined by a front wall, a back wall, a bottom wall, opposed end walls and a pivotal top lid. The self-adjusting striker assembly provides for linear movement of a striker bar, in a direction between the end walls of the box, so that it can properly align with a latch mechanism even if the relationship between the top lid of the box and the box body is altered.

One presently preferred embodiment of the self-adjusting striker assembly of this invention may comprise a base mounted to the top lid of the box assuming the latch mechanism is connected to the box body. The base is formed with an elongated recess within which first and second threaded studs are mounted. A generally L-shaped bracket is provided including a bottom plate formed with first and second openings separated by a partition, and a perpendicular side plate having a slot for mounting a striker bar. The first and second studs of the base are received within respective openings in the bottom plate of the bracket, and such openings at least partially overlie the elongated recess in the base. A first spring is placed in the recess of the base, and extends into the first opening of the bottom plate of the bracket between the first stud and partition. A second spring is placed in the same position in the second opening of the bottom plate. The bottom plate of the bracket is sandwiched between the base and a capture plate which rests atop the bottom plate and mounts to the studs extending from the base.

In alternative embodiments, the L-shaped bracket is received within a channel formed in modified base and retained in place by first and second posts each extending through one of the openings in the bottom plate of the bracket and fixed to the base. A spring element, preferably in the form of one or more plates made of spring steel or similar material, is connected between the bracket and the base.

Unlike the prior art noted above, the self-adjusting striker assembly of this invention permits movement of the bracket, and, in turn, the striker bar, in a linear, side-to-side direction. A guide plate formed with a notch may be mounted to or in proximity with each latch mechanism so that in the event of misalignment between the striker bar and latch mechanism the striker bar may contact the notch in the guide plate and shift its position from side-to-side so as to properly align with and engage the latch mechanism. Additionally, the position of the striker bar within the slot in the side plate of the bracket may be manually adjusted.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
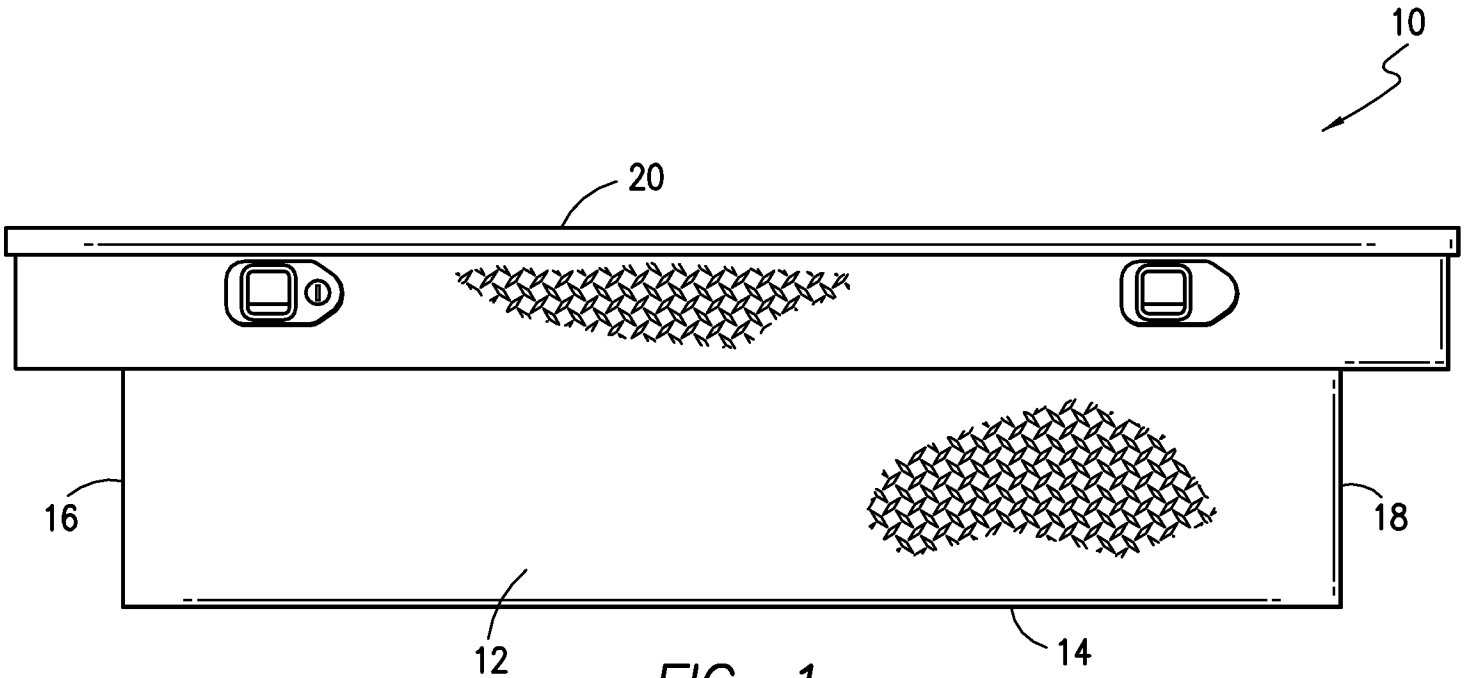
FIG. 1 is a front view of one type of truck box with which the self-adjusting striker assembly of this invention may be utilized.

Referring initially to FIG. 1, a truck tool box 10 is schematically depicted which comprises a front wall 12, a back wall (not shown), a bottom wall 14, opposed end walls 16 and 18, and, a top lid 20 pivotally mounted to the back wall. The walls 12-18 are interconnected to form a hollow interior. It should be understood that the particular configuration of the box 10 shown in FIG. 1 is intended for purposes of illustration only, and the invention described below is applicable to essentially any type of box including various other truck tool boxes such as side mount boxes, chest boxes, top mount boxes and RV boxes. For purposes of the present discussion, terms "front," "rear," "top," "bottom," "upwardly," "downwardly," "inwardly," "outwardly" and the like refer to the orientation of the truck tool box 10 as viewed in FIG. 1.

Figure 2:
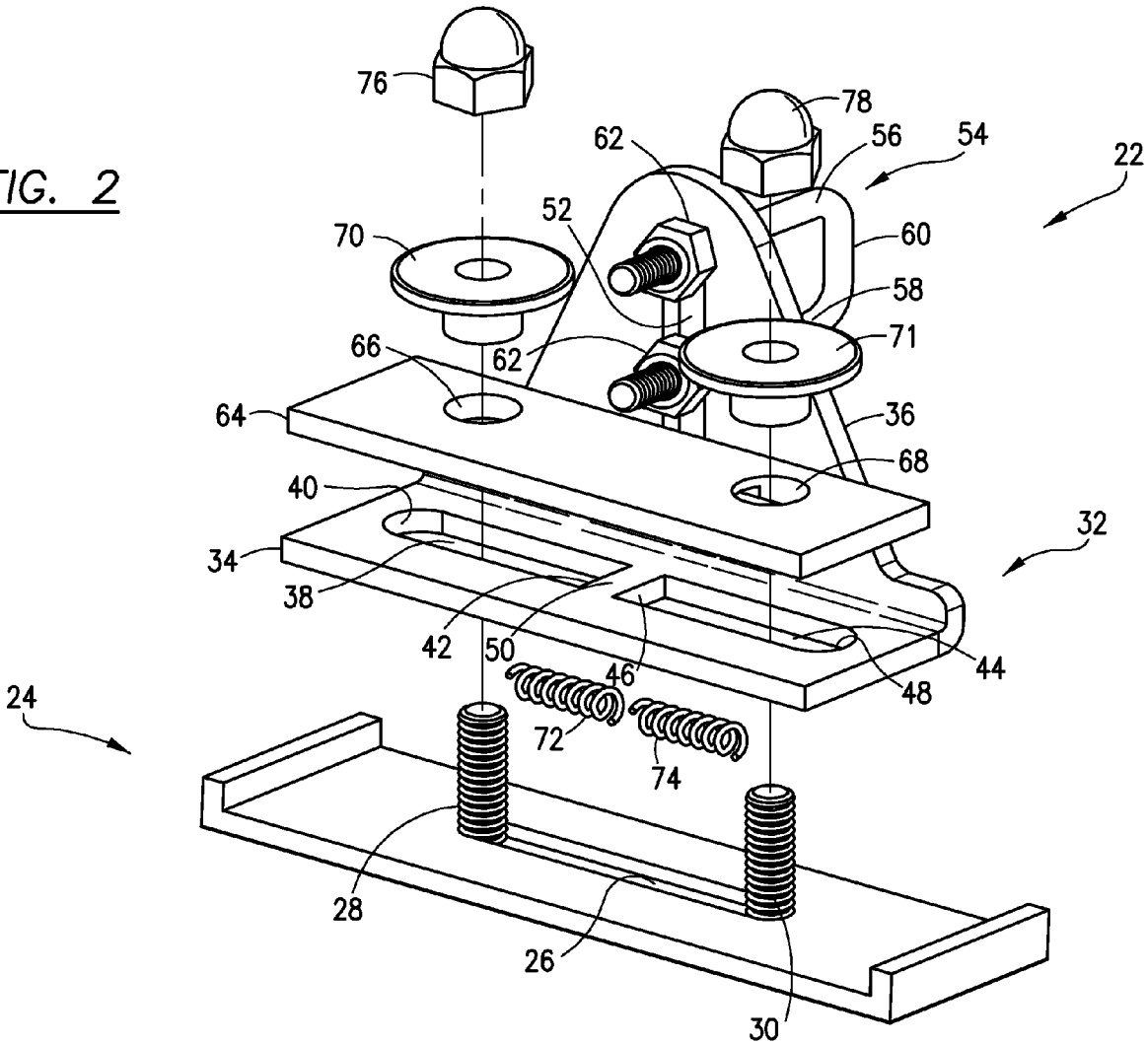
FIG. 2 is a disassembled, perspective view of one embodiment of the assembly herein.
Figure 3:
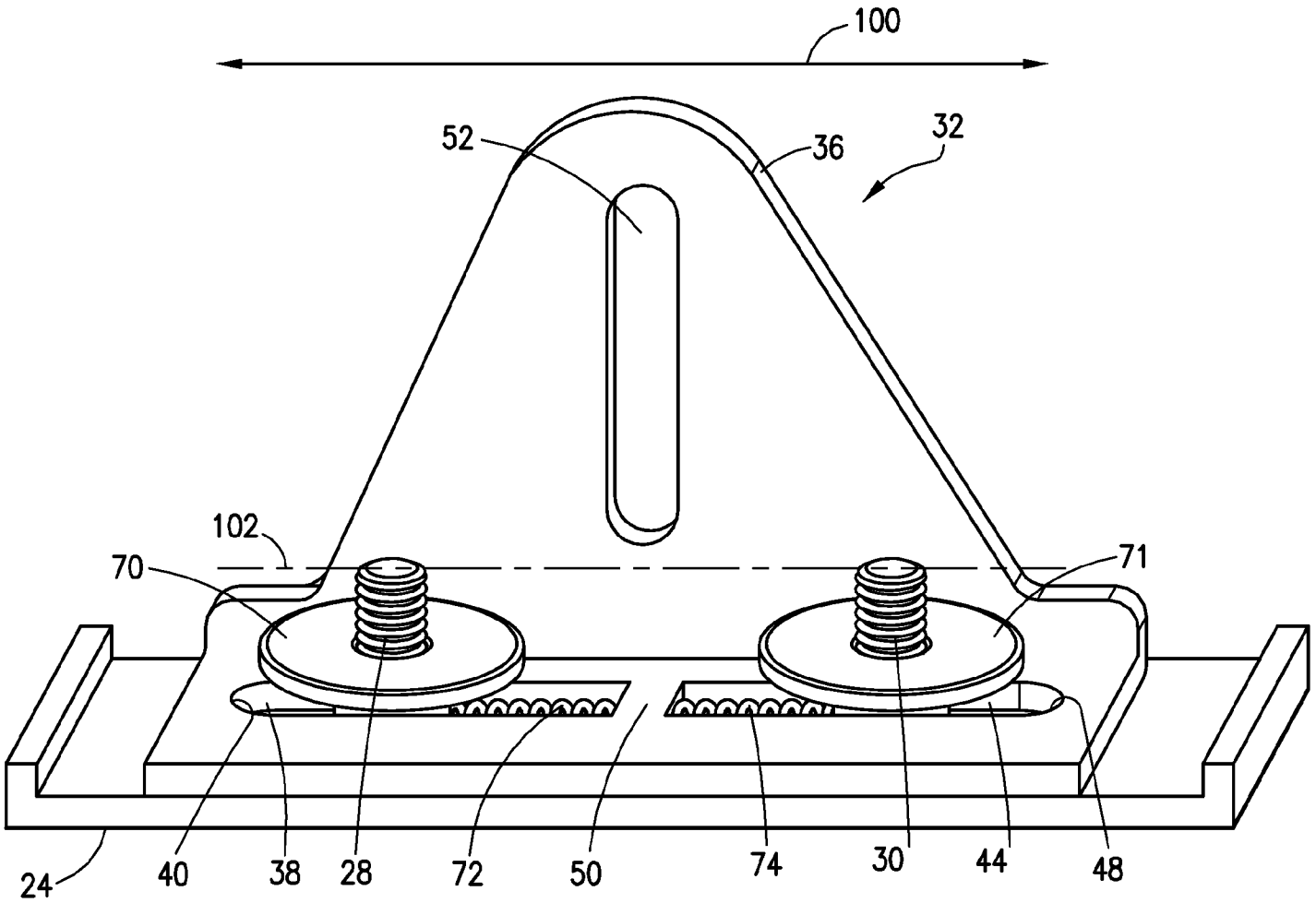
FIG. 3 is a perspective view of a portion of the assembly shown in FIG. 1.

Referring now to FIGS. 2 and 3, one embodiment of a self-adjusting striker assembly 22 according to this invention is illustrated. The assembly 22 comprises a base 24 formed with an elongated recess 26. A threaded stud 28 is mounted at one end of the recess 26, and a second threaded stud 30 is mounted at the opposite end. A generally L-shaped bracket 32 is mounted to the base 10, as described below, and it is formed with a horizontally extending bottom plate 34 connected to or integrally formed with a vertically extending side plate 36.

The bottom plate 34 of bracket 32 is formed with a first opening 38 having opposed ends 40 and 42, and, a second opening 44 having opposed ends 46 and 48. The ends 42 and 46 of openings 38, 44, respectively, are separated by a partition 50. The side plate 36 of the bracket 32 is formed with a vertically extending, elongated slot 52 which mounts a striker bar 54, preferably in the form of a U-bolt. The striker bar 54 has spaced arms 56 and 58 connected by a cross member 60. The end of each arm 56, 58 is threaded to receive nuts 62, one located on either side of the side plate 36, and the position of the striker bar 54 may be adjusted vertically along the slot 52 by loosening the nuts 62, sliding the striker bar 54 to the desired position, and then tightening the nuts 62. A capture plate 64 is also provided which is formed with spaced through holes 66 and 68. Each through hole 66, 68 receives a flange washer 70 and 71, respectively.

The striker assembly 22 may be assembled as follows. Initially, the bottom plate 34 of the bracket 32 is placed onto the base plate 24 so that the stud 28 extends through the first opening 38 in the bottom plate 34 and the stud 30 extends through the second opening 44. As best seen in FIG. 3, a first coil spring 72 is fitted into the recess 26 in base 24 and into that portion of the first opening 38 in the bottom plate 34 of bracket 32 between the partition 46 and stud 28, e.g. the ends of the first coil spring 72 extend between the end 42 of opening 38 and stud 28. Similarly, a second coil spring 74 is fitted into the recess 26 and into that portion of the first opening 44 in the bottom plate 34 between the partition 50 and the stud 30.

With the coil springs 72, 74 in place, the capture plate 64 may be positioned atop the bottom plate 34 of bracket 32 such that the stud 28 of base 24 extends through the opening 66 of the capture plate 64 and the stud 30 extends through the opening 68 therein. The flange washer 70 is inserted through the through hole 68 in capture plate 64, and then through the opening 38 in the bottom plate 34 of bracket 32, onto the stud 28. A portion of the stud 28 protrudes upwardly from the capture plate 64 to receive a cap nut 76. The flange washer 71 is assembled in the same way onto stud 30, and a second cap nut 78 may be tightened down on the exposed end of the stud 30. FIG. 3 illustrates the flange washers 70 and 71 in place on respective studs 28, 30, with the capture plate 64 being removed for ease of illustration. The capture plate 64 and flange washers 70, 71 position the bottom plate 34 of the bracket 32 such that a space is provided between the stud 28 and the end 40 of opening 38 in bottom plate 34 and between the stud 30 and the end 48 of the opening 44.

Figure 4:
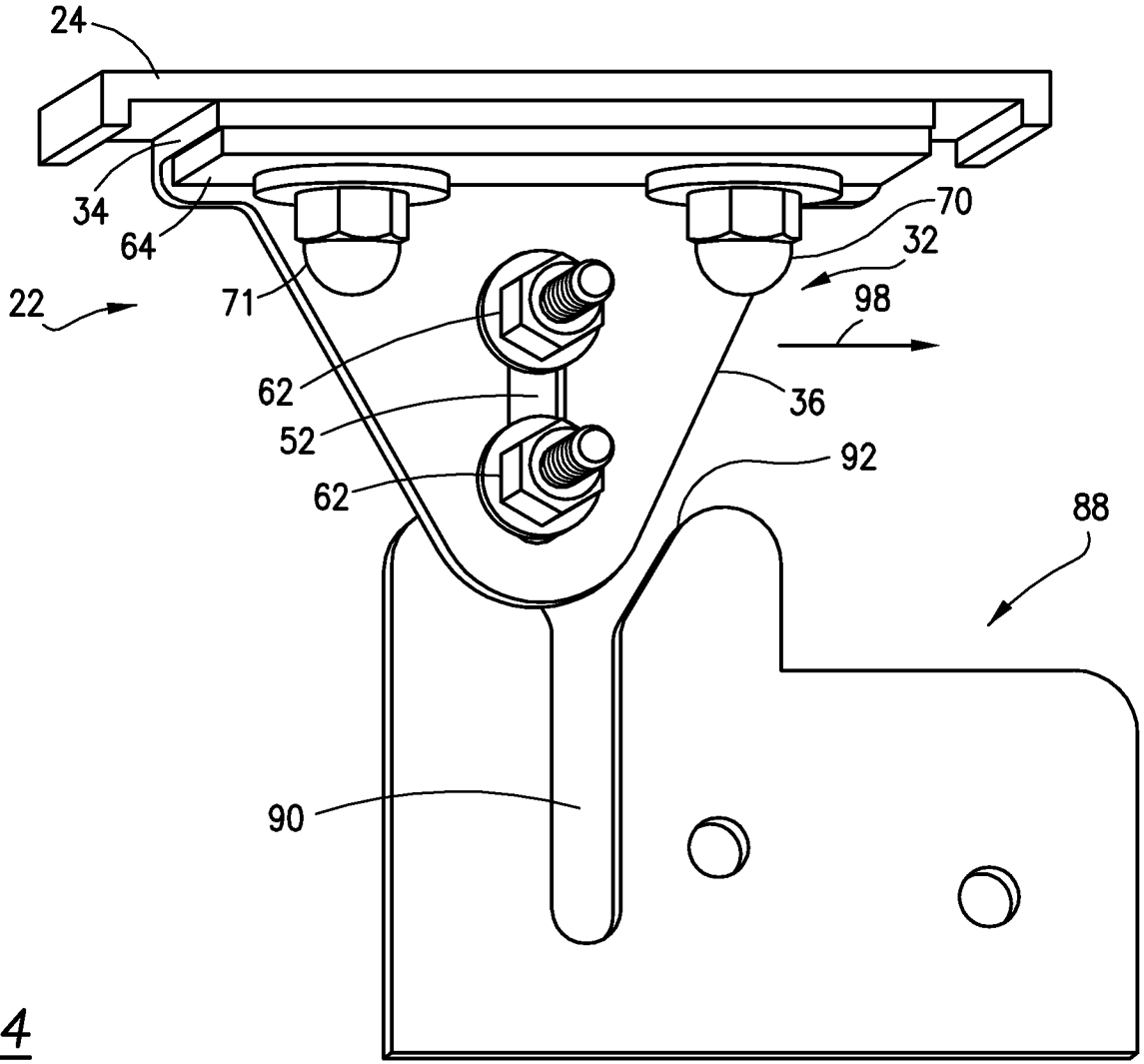
FIG. 4 is a perspective view of the assembly illustrated in FIGS. 2 and 3 in an assembled condition, and a guide plate employed with a latch mounted to the truck box.
Figure 5:
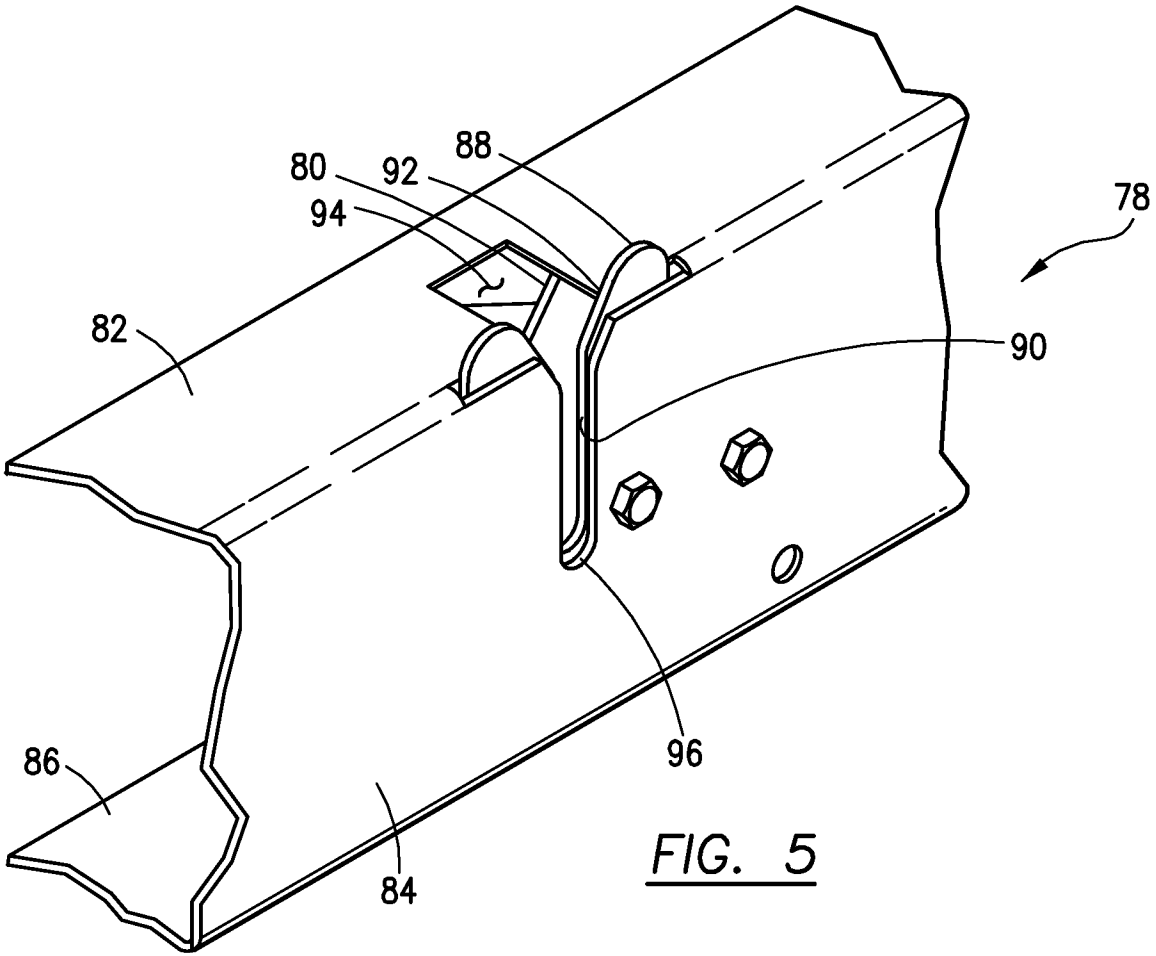
FIG. 5 is perspective view of a portion of a mounting rail located along the front wall of the truck box, showing a portion of a latch and the guide plate depicted in FIG. 4.

As noted above, the striker assembly 22 of this invention is employed with a latch to close, and in some designs, lock the box 10. Referring to FIGS. 4 and 5, a mounting rail 78 may be connected to the front wall 12 of the box 10 to receive and mount a latch 80. The mounting rail 78 has a top plate 82, a side plate 84 and a bottom plate 86 which are connected to form a channel structure as shown in FIG. 5. Only a portion of the mounting rail 78 is depicted in FIG. 5, and it should be understood that it extends along the length of the front wall 12 between the end walls 16, 18. Additionally, preferably two latches 80 and two striker assemblies 22 are employed with most boxes 10.

The guide plate 88 is preferably mounted either on or immediately adjacent to the latch 80. The guide plate 88 is formed with a notch 90 having an expanded mouth or open end 92. A cutout 94 is formed in the top plate 82 of mounting rail 78, and a slot 96 extends along its side plate 84. As seen in FIG. 5, the latch 80 and guide plate 88 are connected to the mounting rail 78 so that the open end 92 of the guide plate 88 aligns with the cutout 94 and its notch 90 aligns with the slot 96 in side plate 84.

In the preferred embodiment, the striker assembly 22 may be mounted to the top lid 20 of the box 10 and the latch 80 may be connected to the moving rail 78 in alignment with the striker assembly 22, e.g. the orientation depicted in FIG. 4. However, it should be understood that the positions of the striker assembly 22 and latch 80 could be reversed. The latch 80 has been removed in FIG. 4 for clarity, and for purposes of the discussion below.

The first and second coil springs 72, 74 bias the bracket 32 to a neutral position as depicted in FIG. 3. The term "neutral" in this context refers to a centered position of the bottom plate 34 of bracket 32 on the base 24. If the striker assembly 22 and latch 80 are correctly aligned with one another, as the top lid 20 is closed the striker bar 54 enters notch 90 in guide plate 88 and extends into engagement with the latch 80 without contacting the guide plate 88 along its open end 92. In the event of misalignment between the striker bar 54 and latch 80, as the top lid 20 is closed the striker bar 54 makes contact with the open end 92 of the notch 90 in guide plate 88. For purposes of illustration, the striker bar 54 is shown engaging the left-hand side of the open end 92 of notch 90 in FIG. 4. With such misalignment, upon contact of the striker bar 54 with the open end 92 of notch 90 the bracket 32 moves to the right along base 10 in the direction of arrow 98. As the top lid 20 continues to close, the striker bar 54 slides along the side of open end 92 and then enters the notch 90 in guide plate 88 so that it can properly engage the latch 80.

Referring to FIG. 3, the connection between the base 24 and bracket 32 allows for side-to-side movement of the bracket 32 with respect to base 24 in the direction of arrow 100. Such movement is linear, e.g. generally along an axis 102 extending in between the studs 28, 30, as schematically depicted in FIG. 3. When misalignment between the striker bar 54 and the notch 90 in guide plate 88 occurs, the bracket 32 is moved to the left or to the right as viewed in FIG. 3 thus compressing one of the first and second coil springs 72, 74. For example, movement of the bracket 32 to the right as viewed in FIG. 3 causes the second coil spring 74 to compress in between stud 30 and partition 50. The opposite stud 28 acts as a stop to limit such right-hand movement because the end 40 of opening 38 in the bottom plate 34 of bracket 32 engages the stud 28 thus preventing further movement to the right. The extent of travel of the bracket 32 to the right is governed by the space between the stud 28 and the end 40 of the opening 38 in bottom plate 34. The same thing occurs upon movement of the bracket 32 to the left as viewed in FIG. 4, e.g. the first coil spring 72 is compressed between the stud 28 and partition 50, and the stud 30 stops such movement to the left upon engagement with the end 48 of opening 44 in the bottom plate 34 of bracket 32. Once the striker bar 54 disengages the latch 80, such as when the top lid 20 is moved to an open position, whichever coil spring 72, 74 that was compressed, as noted above, biases the bracket 32 back to the neutral position.

Figure 6:
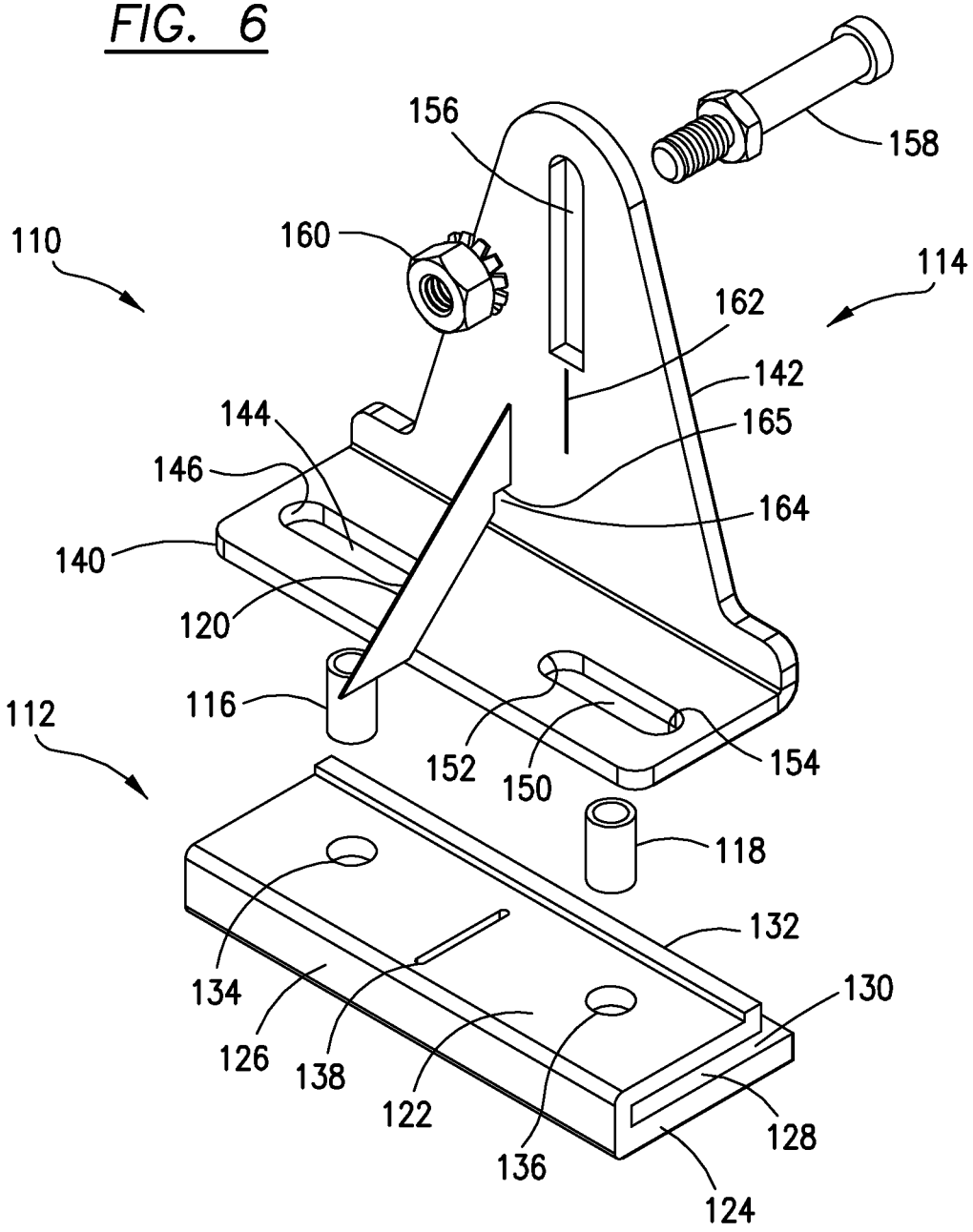
FIG. 6 is a disassembled, perspective view of an alternative embodiment of the self-adjusting striker assembly of this invention.
Figure 7:
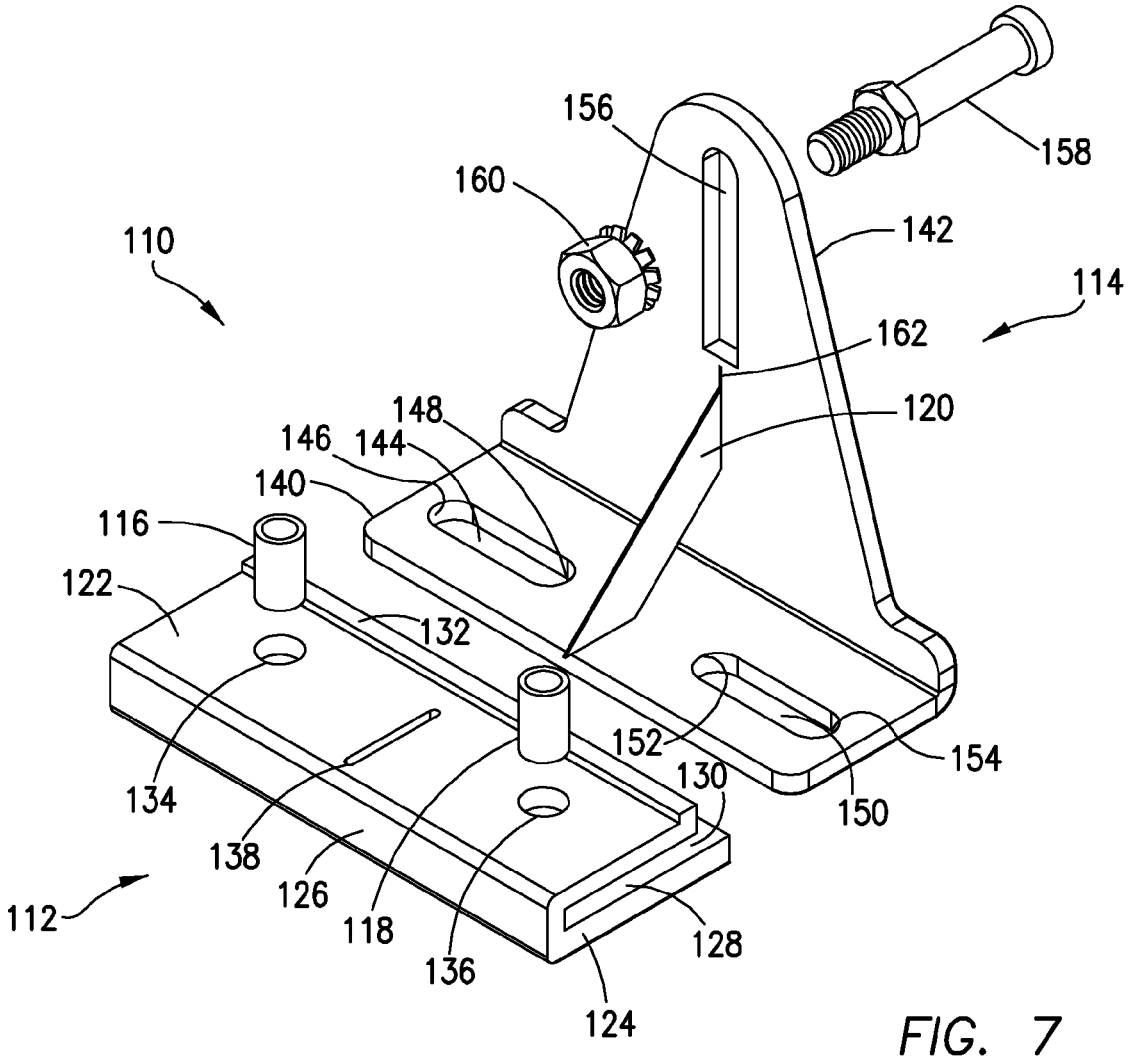
FIG. 7 is a view similar to FIG. 6, except with a spring element mounted to the L-shaped bracket.
Figure 8:
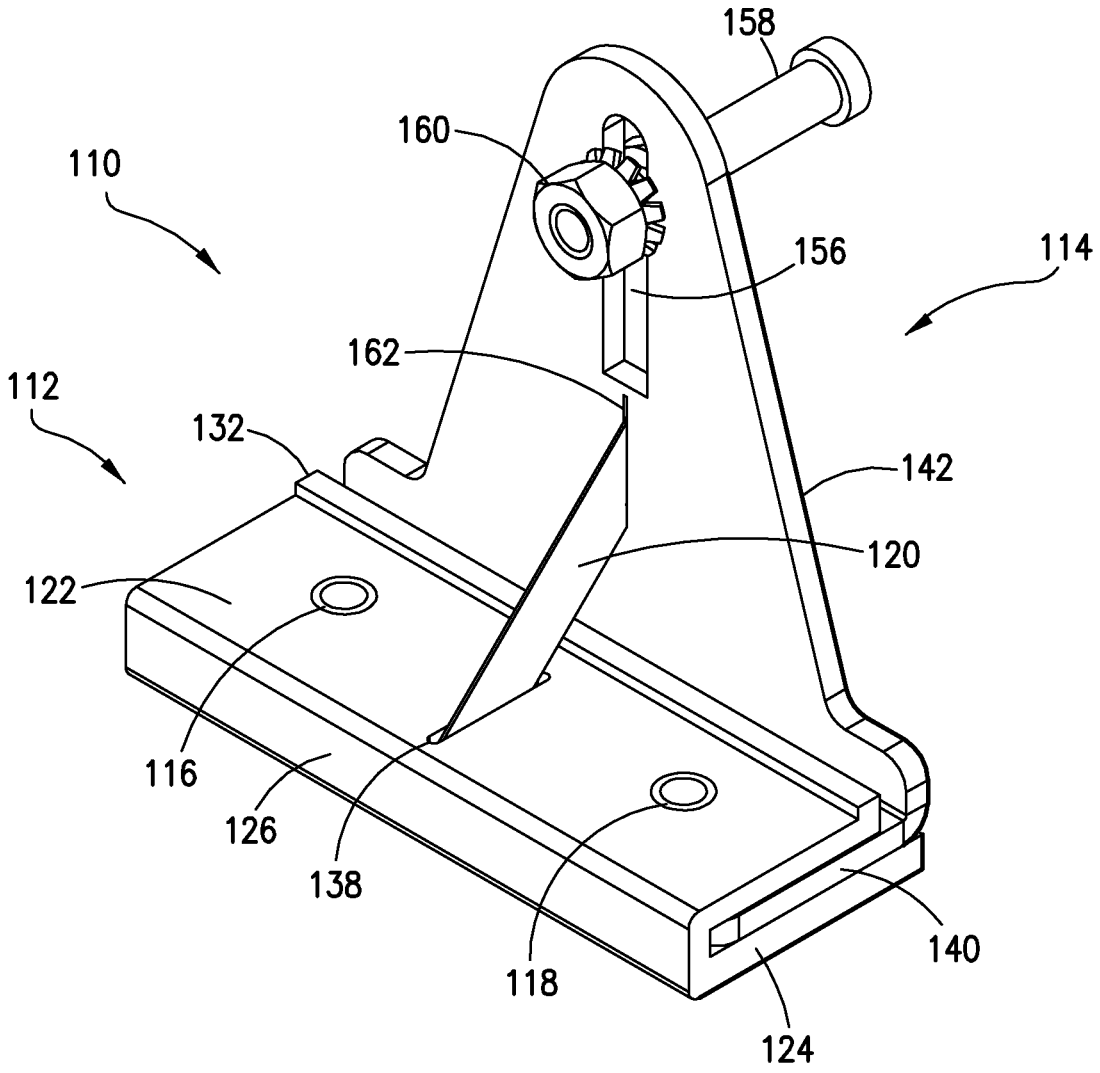
FIG. 8 is an assembled view of the striker assembly shown in FIG. 6.

Referring now to FIGS. 6-8, one alternative embodiment of a self-adjusting striker assembly 110 of this invention is illustrated. The assembly 110 comprises a base 112, a bracket 114, posts 116 and 118, and, a spring element 120. The base 112 includes an upper plate 122 and a lower plate 124 which are joined to one another along a side edge 126 of the base 112 forming a channel 128 between them having an entrance 130 extending along the length of the base 112. The upper plate 122 of base 112 has a lip 132 located at the entrance 130 to the channel 128, and it is formed with spaced bores 134, 136 and a base mounting slit 138.

The bracket 114 comprises a bottom plate 140 connected to a side plate 142. The bottom plate 140 is formed with a first opening 144 having opposed ends 146, 148, and a second opening 150 with opposed ends 152, 154 which is spaced from the first opening 144. The side plate 142 has an elongated slot 156 that may receive a striker bar 158 which may be connected to the side plate 142 by a nut 160. The striker bar 54 shown in FIG. 2 and described above may optionally be connected to the side plate 142. A bracket mounting slit 162 is formed in the side plate 142 of bracket 114, just beneath the elongated slot 156.

The striker assembly 110 may be assembled by inserting the bottom plate 140 of bracket 114 through the entrance 130 and into the channel 128 formed in the base 112. In this position, each of the bores 134 and 136 formed in the upper plate 122 of base 112 align with the openings 144 and 150, respectively, in the bottom plate 140 of bracket 114. The post 116 is inserted through the bore 134 and opening 144 into engagement with the lower plate 124 of base 112, and the post 118 is inserted through bore 136 and opening 150 into engagement with the lower plate 124. The posts 116 and 118 are preferably fixed in place to the upper plate 122 of base 112 by crimping, soldering or any other suitable means. With the base 112 and bracket 114 connected together, one end of the spring element 120 is inserted into the base mounting slit 138 and its opposite end is inserted into the bracket mounting slit 162 where it is fixed in place by soldering or any other means of attachment. A notch 164 may be provided in one end of the spring element 120 forming a generally horizontally extending leg 166, in the orientation depicted in FIGS. 6-8, which rests atop the bottom edge of the bracket mounting slit 162 for additional support. As seen in FIGS. 6-8, the spring element 120 is a single plate preferably made of spring steel or other resilient material which is capable of being deflected in a side-to-side direction but then returning to the position shown in the Figs.

Figure 9:
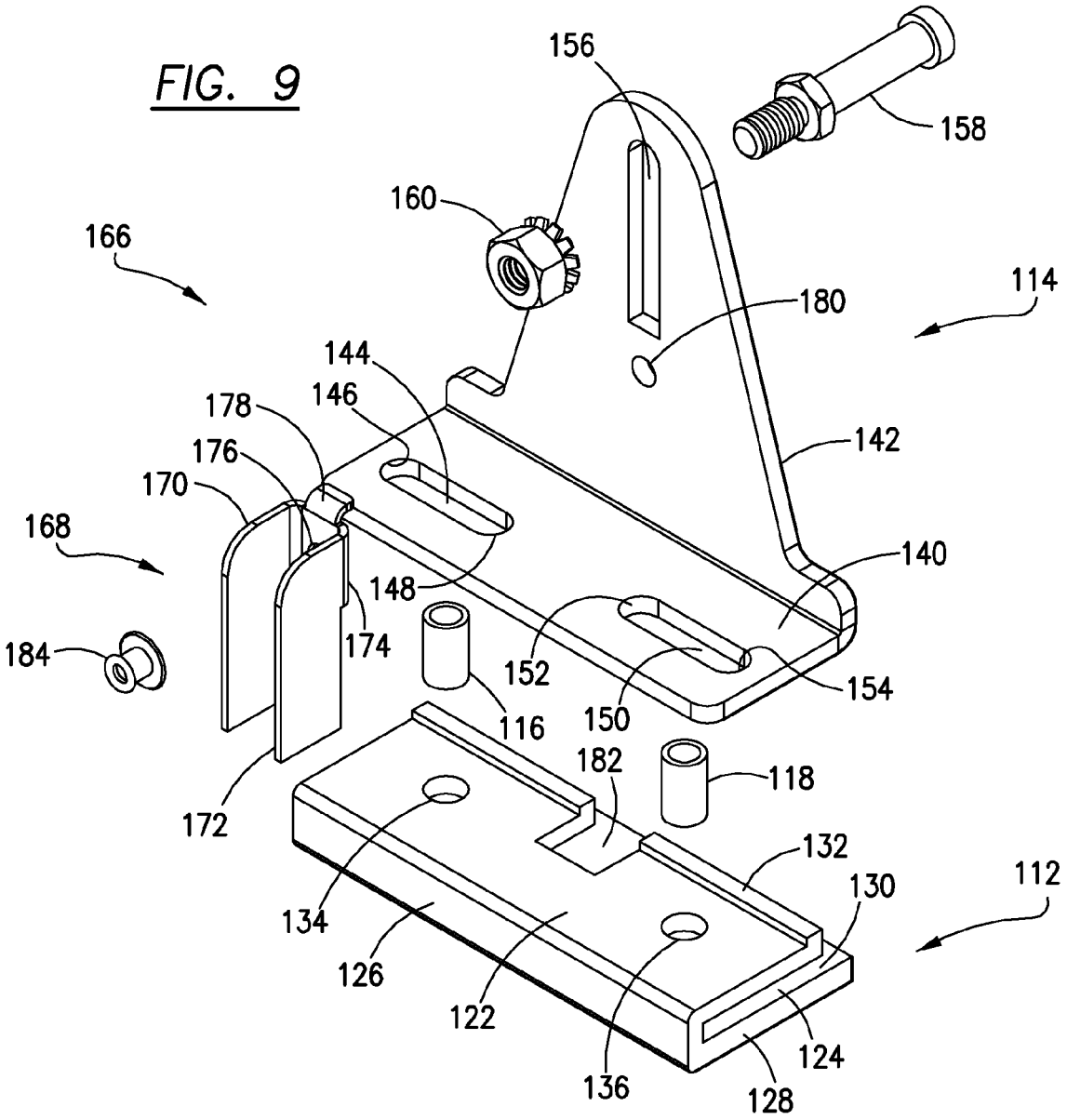
FIG. 9 is a view similar to FIG. 6 except illustrating a still further embodiment of the striker assembly herein.
Figure 10:
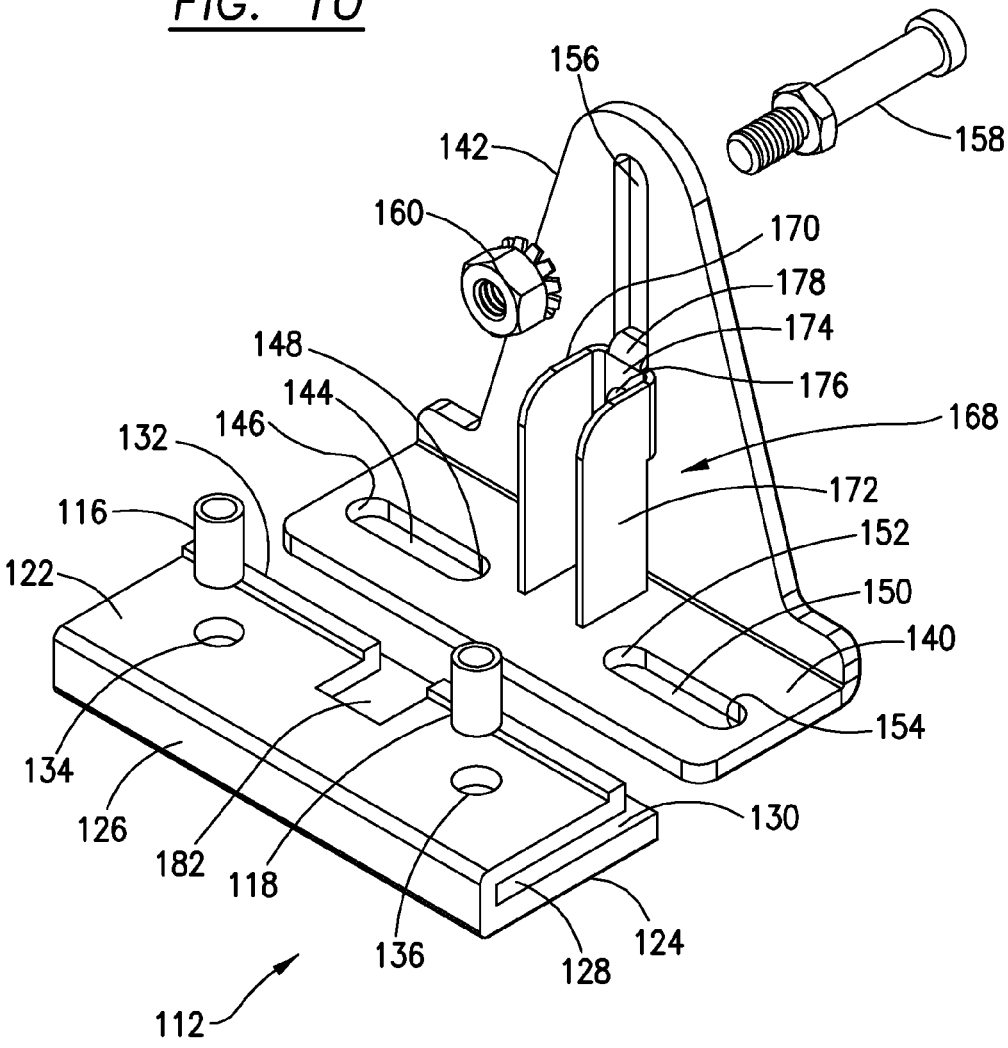
FIG. 10 is a view similar to FIG. 9 except with the spring element mounted to the L-shaped bracket.
Figure 11:
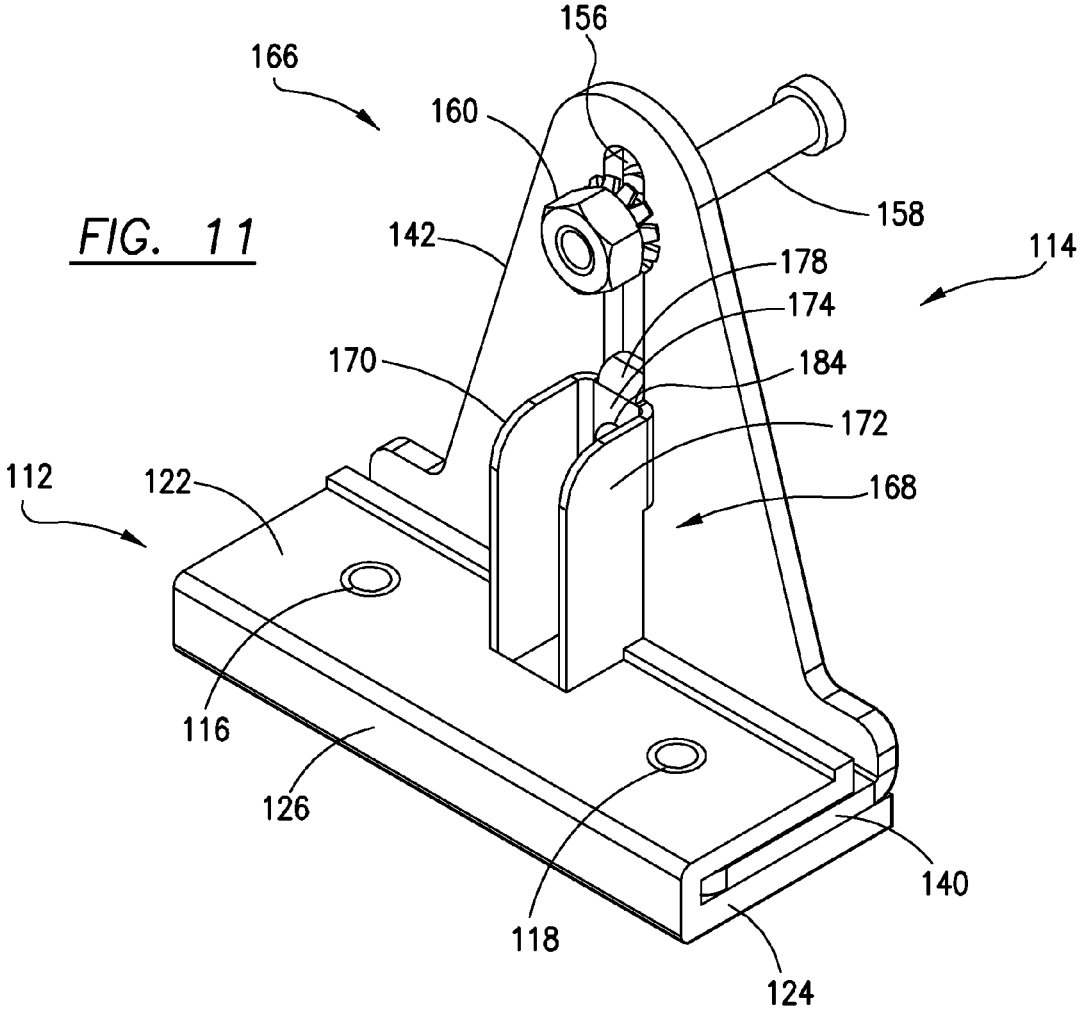
FIG. 11 is an assembled view of the striker assembly illustrated in FIG. 9.

An alternative embodiment of a striker assembly 166 is illustrated in FIGS. 9-11. It is similar to assembly 110, and the structure of assembly 166 which is common to that of assembly 110 is identified with the same reference numbers. The primary difference between the assemblies 110, 166 is that an alternative embodiment of a spring element 168 is employed in assembly 166. Instead of the single plate employed in spring element 120, the spring element 168 in the embodiment of FIGS. 9-11 comprises spaced spring plates 170 and 172 connected by a mounting plate 174. The mounting plate 174 is formed with a bore 176, and a finger 178 is connected to the top of the mounting plate 174.

The base 112 and bracket 114 employed in the assembly 166 of FIGS. 9-11 are modified slightly compared to the assembly 110 in order to accommodate the spring element 168. A hole 180 is formed in the side plate 142 of bracket 114, and the upper plate 122 of base 122 has a cut-out 182. The base 112 and bracket 114 are connected to one another in the same manner as described above in connection with a discussion of FIGS. 6-8. In order to mount the spring element 168 in place, the finger 178 is placed at the bottom of the elongated slot 156 in the side plate 142 of bracket 114 so that the bore 176 in the side plate 142 aligns with the hole 180 in the mounting plate 174 of the spring element 168. A rivet 184 is preferably employed to connect the mounting plate 174 to the side plate 142. The bottom portion of the spring element 168 is received within the cut-out 182 formed in the upper plate 122 of the base 112 where it is attached by soldering or other suitable means.

Both of the striker assemblies 110 and 166 operate in a manner generally similar to the striker assembly 22, and are intended for use with a latch 80 as described above with reference to a discussion of FIGS. 4 and 5. Essentially the same linear or side-to-side movement of the bracket 114 relative to the base 112 is achieved in the assemblies 110 and 166 as that obtained with the assembly 22. The bracket 114 is linearly movable relative to the base 112 to the extent permitted by the dimensions of the openings 144 and 150 in the bottom plate 140 of bracket 114. In one direction of linear motion, the post 116 engages the side 146 of opening 144 and the post 118 engages the side 152 of opening 150 to establish the limit of such motion in that direction. Linear movement of the bracket 114 in the opposite direction is stopped upon contact of the post 116 with the side 148 of opening 144 and contact of post 118 with the side 154 of opening 150. Each of the spring elements 120 and 168 of respective assemblies 110 and 166 act to bias the bracket 114 to a neutral or generally centered position relative to base 112. When the bracket 114 is moved in one linear direction or the other, due to misalignment of the striker bar 158 or 60 with the notch 90 in guide plate 88 of latch 80, the spring elements 120, 168 deflect in such direction of movement but then are effective to return the bracket 114 to such neutral position.

The striker assemblies 22, 110 and 166 provides a convenient means of accommodating misalignment between the striker bar 54 and latch 80 in a side-to-side direction, e.g. linearly, generally along axis 102. In some instances, the striker bars 54 or 158 may fail to properly engage the latch 80 due to a vertical misalignment. The term "vertical misalignment" refers to the relative position of the striker bars 54 or 158 and latch 80 when the top lid 20 is closed, wherein the striker bars 54 or 158 fail to seat within the latch 80 or are positioned too close to the latch 80. In that event, the striker bar 54 may be moved along the slot 52 in the side plate 36 of bracket 22, or the striker bar 158 may be moved along the slot 156 in the side plate 142 of bracket 114, in a direction toward or away from the latch 80 when the top lid 20 is closed.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A box, comprising:

a number of interconnected walls forming a hollow interior having an open top, a lid movable between an open position and a closed position relative to said open top;

a latch mounted to one of said walls or to said lid;

a striker assembly comprising:

(a) a base mounted to the other of said one wall and said lid, said base having at least one post and being formed with a mounting slit;

(b) a bracket formed with a side plate connected to a bottom plate, said side plate being formed with a mounting slit and said bottom plate being formed with at least one opening having a first end and a second end, said bracket being mounted to said base in such a way that said at least one post extends through said at least one opening;

(c) a spring element having a first end and a second end, said first end of said spring element being received within said mounting slit formed in said base and being connected thereto, said second end of said spring element being received within said mounting slit formed in said side plate of said bracket and being connected thereto;

(d) a striker bar mounted to said bracket in position to engage said latch upon movement of said lid to said closed position, said bracket being movable relative to said base in the event of misalignment between said striker bar and said latch.

2. A box, comprising:

a number of interconnected walls forming a hollow interior having an open top, a lid movable between an open position and a closed position relative to said open top;

a latch mounted to one of said walls or to said lid;

a striker assembly comprising:

(a) a base mounted to the other of said one wall and said lid, said base having at least one post;

(b) a bracket formed with at least one opening having a first end and a second end, said bracket being mounted to said base in such a way that said at least one post extends through said at least one opening;

(c) a spring element connected between said base and said bracket, said spring element including a first spring plate spaced from a second spring plate, said first and second spring plates being connected by a mounting plate;

(d) a striker bar mounted to said bracket in position to engage said latch upon movement of said lid to said closed position, said bracket being movable relative to said base in the event of misalignment between said striker bar and said latch.

3. The box of claim 2 in which said mounting plate is connected to said bracket and each of said first and second spring plates is connected to said base.

4. A striker assembly adapted for use with a box formed by a number of interconnected walls defining a hollow interior with an open top, a lid moveable relative to the open top between an open and closed position, and, a latch mounted to the lid or to one of the walls, said striker assembly comprising:

a base adapted to mount to the other of the one wall or lid of the box, said base having at least one post;

a bracket formed with a side plate connected to a bottom plate, said side plate being formed with a mounting slit and said bottom plate being formed with at least one opening having a first end and a second end, said bracket being mounted to said base in such a way that said at least one post extends through said at least one opening;

a spring element having a first end and a second end, said first end of said spring element being received within said mounting slit formed in said base and being connected thereto, said second end of said spring element being received within said mounting slit formed in said side plate of said bracket and being connected thereto;

a striker bar mounted to said bracket, said striker bar being adapted to engage the lid of the box upon movement of the lid to the closed position, said bracket being moveable relative to said base in the event of misalignment between said striker bar and the latch.

5. A striker assembly adapted for use with a box formed by a number of interconnected walls defining a hollow interior with an open top, a lid moveable relative to the open top between an open and closed position, and, a latch mounted to the lid or to one of the walls, said striker assembly comprising:

a base adapted to mount to the other of the one wall or lid of the box, said base having at least one post;

a bracket formed with at least one opening having a first end and a second end, said bracket being mounted to said base in such a way that said at least one post extends through said at least one opening;

a spring element connected between said base and said bracket, said spring element including a first spring plate spaced from a second spring plate, said first and second spring plates being connected by a mounting plate;

a striker bar mounted to said bracket, said striker bar being adapted to engage the lid of the box upon movement of the lid to the closed position, said bracket being moveable relative to said base in the event of misalignment between said striker bar and the latch.

6. The striker assembly of claim 5 in which said mounting plate is connected to said bracket and each of said first and second spring plates is connected to said base.

* * * * *